US006213159B1

(12) United States Patent
Debaes

(10) Patent No.: US 6,213,159 B1
(45) Date of Patent: Apr. 10, 2001

(54) SHARPENING DEVICE FOR THE CUTTING KNIFE OF A FACE-TO-FACE WEAVING MACHINE

(75) Inventor: Johnny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/415,917

(22) Filed: Oct. 12, 1999

(30) Foreign Application Priority Data

Oct. 12, 1998 (BE) ..... 09800735

(51) Int. Cl.[7] ..... D03D 45/50

(52) U.S. Cl. ..... 139/1 R; 139/263; 139/291 C; 451/45; 451/48; 451/49

(58) Field of Search ..... 139/1 R, 43, 263, 139/291 C; 451/45, 48, 49

(56) References Cited

U.S. PATENT DOCUMENTS 3,562,801 2/1971 Stucker ..... 51/246
4,100,946 * 7/1978 Limonta ..... 139/291

FOREIGN PATENT DOCUMENTS 0 437 329 A2 7/1991 (EP) .
2 012 734 3/1970 (FR) .

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A sharpening device for the cutting knife (12) of a face-to-face weaving machine, comprising a belt-shaped sharpening means (4) of a flexible material provided with a sharpening face that is so disposable that the cutting knife (12) during its back and forth going movements comes into contact with this sharpening face, and that is movable in order to bring various areas of the sharpening face within reach of the cutting knife (12).

The sharpening means (4) can be unwound from a reel (7) and be wound up by another reel (3) in order to bring several areas of the sharpening face within reach of the cutting knife (12). The two reels (3), (7) and the belt-shaped sharpening means (4) can be made as a detachable unit. The sharpening means (4) preferably runs with the sharpening part over an elastically disposed curved surface (9).

11 Claims, 4 Drawing Sheets

SHARPENING DEVICE FOR THE CUTTING KNIFE OF A FACE-TO-FACE WEAVING MACHINE

BACKGROUND OF THE INVENTION

This invention relates to a sharpening device for the cutting knife of a face-to-face weaving machine, comprising a belt-shaped sharpening means provided with a sharpening face that is so disposable that the cutting knife during its movements comes into contact with this sharpening face, and that is movable in order to bring various areas of the sharpening face within reach of the cutting knife.

This invention also relates in particular to a face-to-face weaving machine provided with one or several such sharpening devices.

On face-to-face weaving machines two fabrics are woven one above the other, while pile warp threads are alternately interlaced in the top and in the bottom fabric. The pile warp threads, which connect both fabrics, are split on the weaving machine between the two fabrics, so that two separate pile fabrics are obtained. This occurs by means of a cutting device provided on the weaving machine.

This cutting device consists of a knife carriage onto which a cutting knife is attached. The knife carriage is movably disposed on a cutting bench extending according to the weft direction, and is moved back and forth on this cutting bench by means of a drive device, so that the pile warp threads are cut through by the cutting knife.

In order to obtain pile fabrics of an acceptable quality all pile warp threads must be cut through with a razor sharp cutting knife.

Because it is desired to have the cutting knife work uninterruptedly for a long time, while it nevertheless remains sufficiently sharp, it is known to provide a sharpening device on the weaving machine, with which the cutting knife can be sharpened during its back and forth going movements.

A known sharpening device is described in the French patent publication no. FR-2.556.638, and comprises two sharpening stones between which the cutting knife is moved at the end of the cutting bench. The sharpening stones are attached on elastic holders. At each extremity of the cutting bench such a sharpening device can be disposed.

There are two sharpening stone shapes in use. On the one hand there are the flat beam-shaped sharpening stones with a cambered sharpening face and on the other hand there are the round sharpening stones which have a conical sharpening face.

In the Belgian patent no. 899187 a sharpening device is described with which the sharpening can be interrupted in order to limit the wear of the cutting knife. In this device two beam-shaped sharpening stones with a curved sharpening face are provided, which are so disposed that the cutting knife moves between these sharpening stones and comes into contact with their respective sharpening faces.

In DE-GM-8412711 an elastic disposition for such sharpening stones is described.

In the Belgian patent no. 900272 a sharpening device is described with the characteristics mentioned in the first paragraph of this specification. This device comprises namely an elastically disposed round sharpening stone with a conical-shaped sharpening face, and is rotatable so that the cutting knife during rotation of the sharpening stone does not always come into contact in the same place with this sharpening stone.

In FR-2012734 a sharpening device with a belt-shaped endless sharpening means is described. By driving the sharpening belt in a circular movement various areas of the belt can be brought within reach of the cutting knife.

A number of disadvantages are however linked to these known sharpening devices.

In order to limit the wear and tear of the cutting knife the sharpening pressure may not be set high. On the other hand the sharpening pressure must be just sufficient in order to rub the abrasive grains of the sharpening face with every passage of the cutting knife against the edge of the knife.

When weaving, components of the yarn remain sticking to the cutting knife. With the sharpening movement these components are deposited on the sharpening face of the sharpening stones. The abrasive grains of the sharpening stones are embedded with these impurities so that the sharpening action is no longer efficient.

The weaving machine because of this weaves fabrics with a bad cut. Fabrics with a bad cut show pile stripes and shagginess. These disadvantages often lead to increased finishing costs of the pile fabric or result in the pile fabric having to be sold as a fabric of lesser quality, or even being no longer sellable. This is especially the case for velveteen or velvet with artificial and synthetic pile yarns.

The sharpening means of the known sharpening devices often have to be cleaned. This can only occur during standstill of the weaving machine with loss of production as inevitable result.

With the known sharpening devices the sharpening means after a certain standing time furthermore also exhibits a trace because of the fact that the abrasive grains come loose from their embedment. The sharpening surface is then no longer intact with a bad sharpening action as result. The sharpening means then has to be replaced, which again leads to a standstill of the weaving machine.

The purpose of this invention is to provide a sharpening device with which the disadvantages mentioned above are remedied.

SUMMARY OF THE INVENTION

This purpose is achieved according to this invention by a sharpening device with the characteristics mentioned in the first paragraph of this specification, of which the sharpening means is wound up on at least one rotatable reel, while the sharpening device is provided in order to unwind the sharpening means from this reel and wind it up on another reel in order to bring various areas of the sharpening face within reach of the cutting knife.

Such a sharpening means can be made with a considerable length and can be driven with simple means according to its longitudinal direction. With such a sharpening means a sharpening face is provided on the weaving machine with a length (this is the dimension according to the direction of movement of the sharpening means) which is much greater than with the known round sharpening stones, where this length is limited to the circumference of the sharpening stone. Also compared to the known belt-shaped sharpening means the sharpening belts according to the invention can be much longer, while the device can remain simple and compact. Because of this the sharpening device can operate uninterruptedly for a long time, while the cutting knife is nevertheless sharpened by an intact sharpening surface. Because of this the number of standstills of the weaving machine is reduced with an increase in productivity as result. Because of the fact that at the same time the number of manual interventions per weaving machine is reduced, this invention furthermore also results in a reduction in the maintenance costs.

A preferred embodiment of the sharpening device according to this invention comprises a curved surface, over which the sharpening means extends, while the sharpening means can be disposed with an area of the sharpening face extending opposite this curved surface within reach of the cutting knife.

Because of the fact that the sharpening means is flexible and extends over a curved surface it is brought into a corresponding curved position. Because of this a sharpening area (the area of the sharpening face which comes into contact with the cutting knife) is obtained with a very small surface area, so that the cutting knife can be sharpened with a minimum wear.

With another preferred embodiment the curved surface is part of a spring-mounted part of the device. Because of this an optimum sharpening pressure between the sharpening face and the cutting knife can be achieved.

With a particularly preferred embodiment the sharpening means is connected to two rotatable reels and wound up on at least one reel, while an area of the sharpening face extending between both reels can be brought within reach of the cutting knife, and while the sharpening device comprises means for unwinding the sharpening means from one reel and winding it up on the other reel in order to bring various areas of the sharpening face within reach of the cutting knife.

According to this invention a sharpening means with a very great length can be provided, so that a very long uninterrupted operation of the sharpening device becomes possible.

If the aforesaid reels are detachably provided on a respective rotary shaft, the replacement of a sharpening means by another sharpening means can be performed quickly. This reduces the standstill time of the weaving machine when replacing a sharpening means.

In a greatly preferred embodiment the sharpening means and the reels form a unit which is detachably provided on the device. The sharpening means can for example be incorporated in a type of cassette which can very quickly be replaced on the sharpening device by another cassette. The situation is comparable to the replacement of an audio cassette. Because of this the duration of the weaving machine standstills for the replacement of a sharpening means is restricted to an absolute minimum.

Such a sharpening unit for a sharpening device is in itself also an object of this invention for which protection is claimed. This detachable unit comprises two rotatable reels, and a belt-shaped sharpening means provided with a sharpening face which is wound up on at least one reel and runs from one reel to the other, while the unit can be provided on the device in an operating position whereby an area of the sharpening face is within reach of the cutting knife, and whereby the sharpening means can be unwound from one reel and can be wound up on the other reel in order to bring various areas of the sharpening face within reach of the cutting knife.

Preferably the sharpening means can be driven continuously or with intervals. This drive can furthermore also be operated by means of a programmable control.

The sharpening device according to this invention furthermore preferably also comprises a tensioning device for the belt-shaped sharpening means.

This sharpening device can also further be provided with a cleaning device for the sharpening means. This can be a brushing device, a blowing device, a device with a cleaning fluid tank, or a combination of several of these devices.

The inclination and the position of the sharpening device are preferably also adjustable, so that it is possible to dispose the sharpening face quickly in an optimum position for the sharpening operation in relation to the movement path of the cutting knife.

This invention furthermore also relates to a face-to-face weaving machine provided with one or several sharpening devices according to this invention. Preferably two sharpening devices according to this invention are disposed one above the other at an extremity of the movement path of the cutting knife. The respective sharpening faces are then respectively above and below the movement path of the cutting knife. A respective sharpening device or a respective set of two sharpening devices disposed one above the other can also be provided at both extremities of the movement path of the cutting knife.

BRIEF DESCRIPTION OF THE DRAWINGS

In the following specification two preferred embodiments of the sharpening device according to this invention are described in detail. This specification only serves to explain further the properties and advantages of this invention and may not be considered as a restriction on the protection claimed for this invention in the claims of this patent application.

In this specification reference is made to the figures attached hereto, of which

DETAILED DESCRIPTION

The sharpening devices represented in the figures are disposed in the vicinity of the extremity of the cutting bench (11) of a face-to-face weaving machine. A knife carriage (13) provided with a cutting knife (12) is placed on this cutting bench (11). The knife carriage (13) can be moved back and forth on the cutting bench (11) by means of a drive device (not represented in the figures) so that the cutting knife (12) cuts through pile warp threads during the face-to-face weaving.

Figure 1:
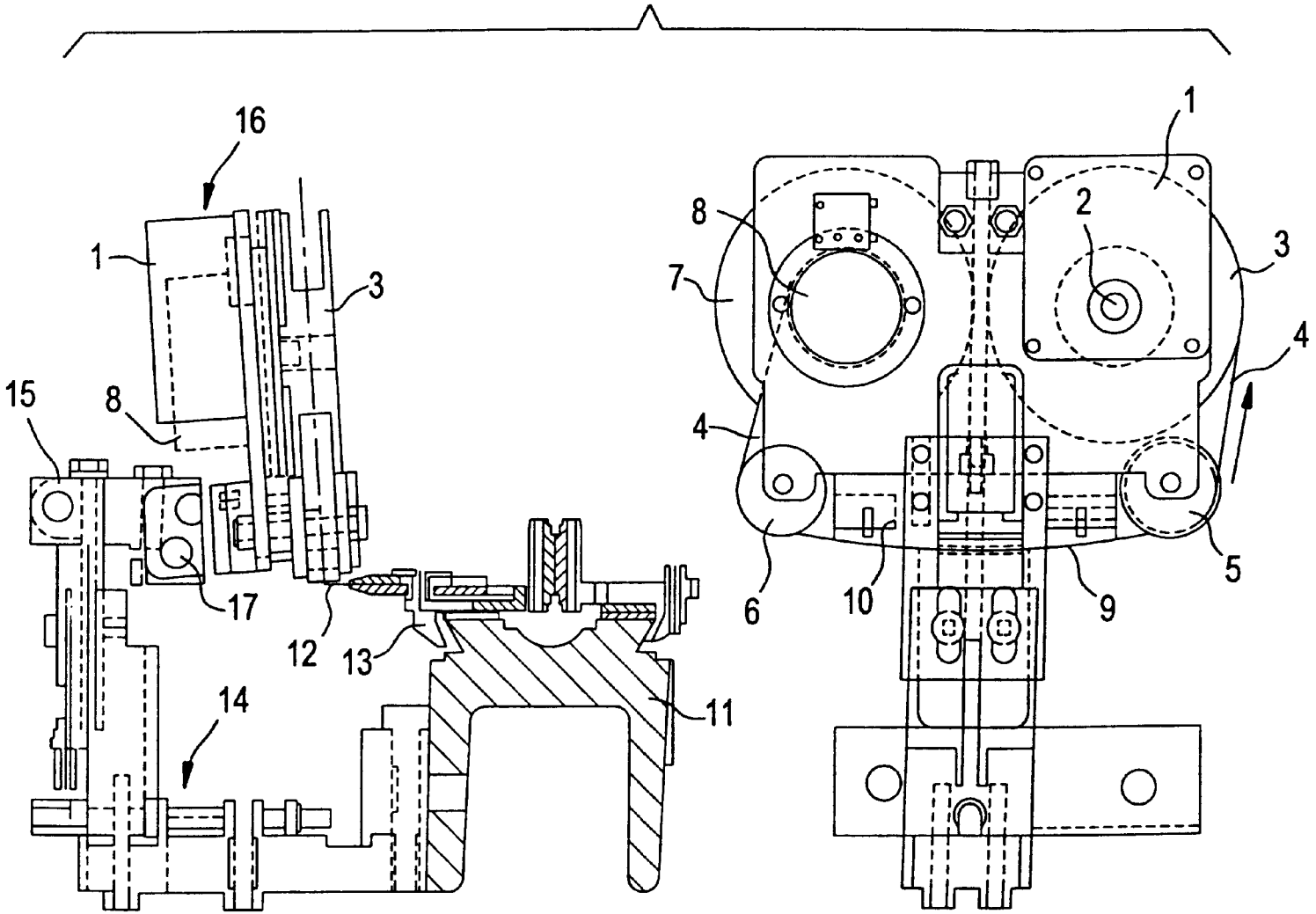
FIG. 1 represents a side elevation and a front view of an embodiment of the sharpening device, which is disposed above the cutting knife.
Figure 2:
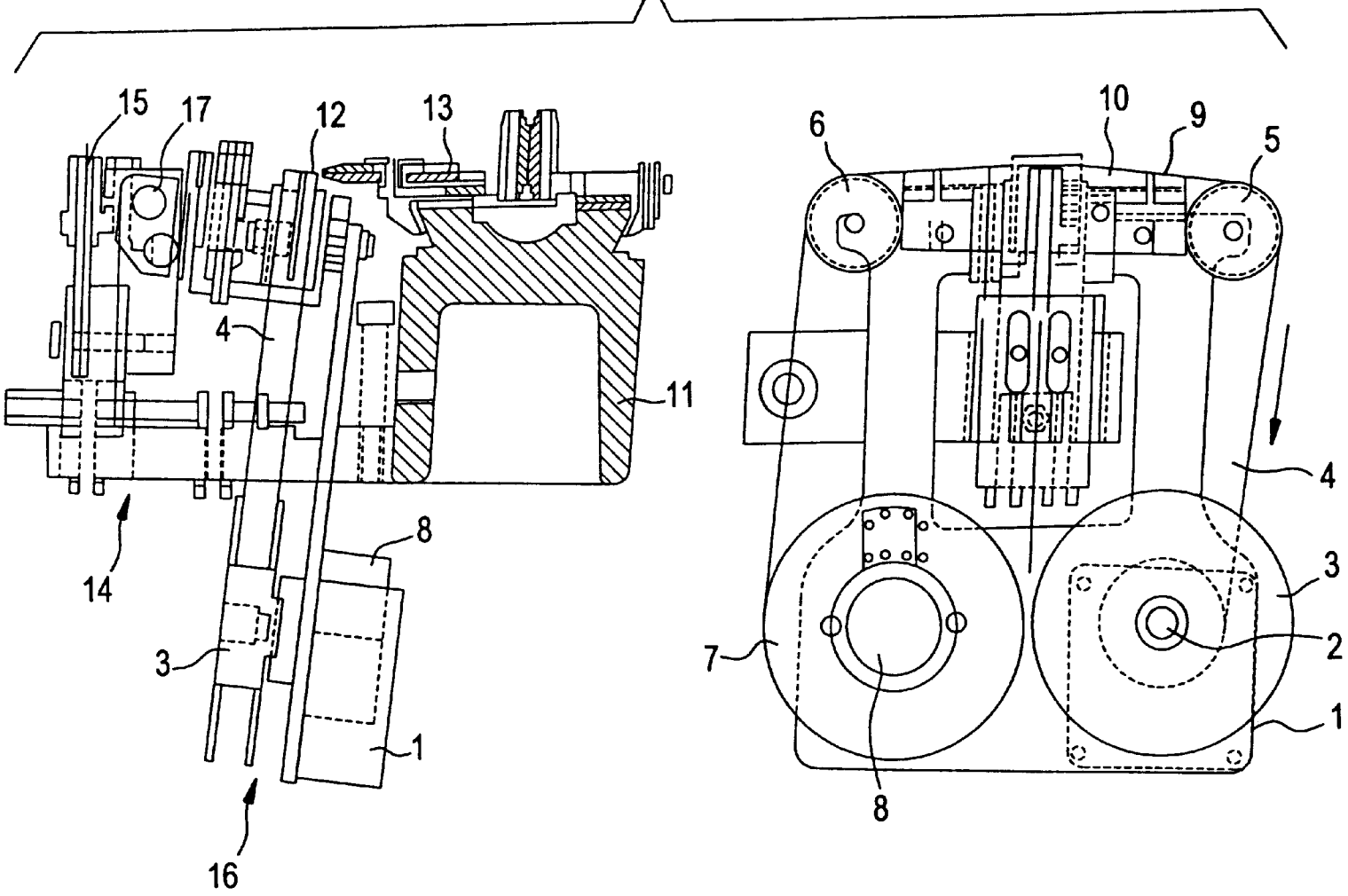
FIG. 2 represents a side elevation and a front view of an embodiment of the sharpening device, which is disposed below the cutting knife.

In the left-hand drawing of FIGS. 1 and 2 in each case a cross-section of the cutting bench (11) is represented, whereby the longitudinal direction of the cutting bench (11), and therefore also the direction of movement of the knife carriage (13), extends perpendicular to the plane of the cross-section.

The sharpening device is disposed along the side of the cutting knife (12) along the cutting bench (11) on a supporting structure (14) which is connected to the chassis of the weaving machine. The sharpening device comprises a base (15) which is so connected to the supporting structure

(14) that this base (15) in relation to the supporting structure (14) is adjustable in horizontal and vertical direction, in the plane perpendicular to the direction of movement of the cutting knife (12).

The sharpening device furthermore also comprises a body (16) that is rotatably connected around a rotary shaft (17) to the base (15). The inclination of this body (16) is also adjustable in relation to the base (15).

With the embodiment represented in FIGS. 1 and 2 the body (16) bears an electric motor (1), which is provided for enabling a reel spindle (2) to rotate. A first reel (3) provided on this reel spindle (2) can be driven in that manner in order to rotate and in order to wind up a sharpening belt (4) connected thereto. This sharpening belt (4) runs over two capstans (5), (6) to a second rotatably disposed reel (7) which is slowed down by means of a braking system (8). The sharpening belt (4) is wound up on the second reel (7), and is unwound there from by driving the first reel (3).

Between the two capstans (5), (6) the sharpening belt (4) runs over the curved surface (9) of a spring-mounted table (10). This spring-mounted or elastic disposition can be realized with an ordinary spring but a hinged disposition with a drawback means or foam rubber are also some of the possibilities. We shall return to this later in this specification.

The sharpening belt (4) along the side directed toward the cutting knife (12) is provided over the entire length with a sharpening surface. This sharpening surface is obtained in known manner, for example by embedding abrasive grains.

The base (15) of the sharpening device is so positioned and the inclination of the body (16) is so adjusted that the cutting knife (12), with every passage along the sharpening device, is slid over an area of the sharpening face on the curved surface (9).

By driving the first reel (3) the sharpening belt (4) is shifted forward continuously or with intervals, so that the cutting knife (12) is in each case pulled over an intact sharpening surface. The sharpening device can because of this operate uninterruptedly for a very long time. The driving of the sharpening belt (4) by means of the electric motor (1) occurs in function of the weaving circumstances. This driving is operated by means of a programmable control device.

The reels (3), (7) with the sharpening belt (4) wound thereon can easily be removed from their respective reel spindles and be replaced by other reels with a new sharpening belt. Because of this invention the replacement of the sharpening means (4) has become a very simple and quick task to perform. The reels (3), (7) and the sharpening belt (4) wound thereon can also be produced as a unit which is very easy to remove and replace.

Figure 3:
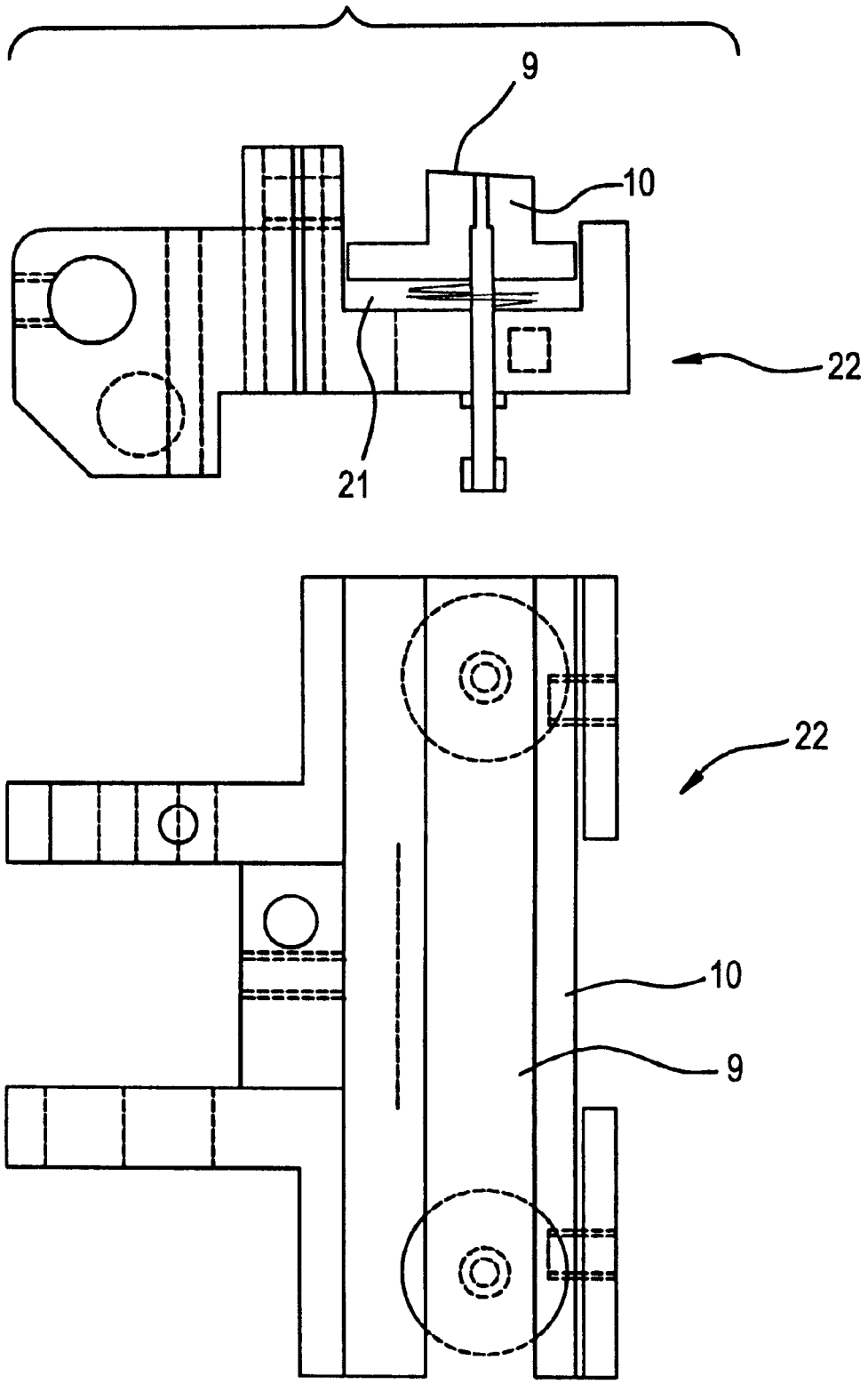
FIG. 3 represents a side elevation and an additional view from above of a first elastic disposition of the table of the sharpening device.
Figure 4:
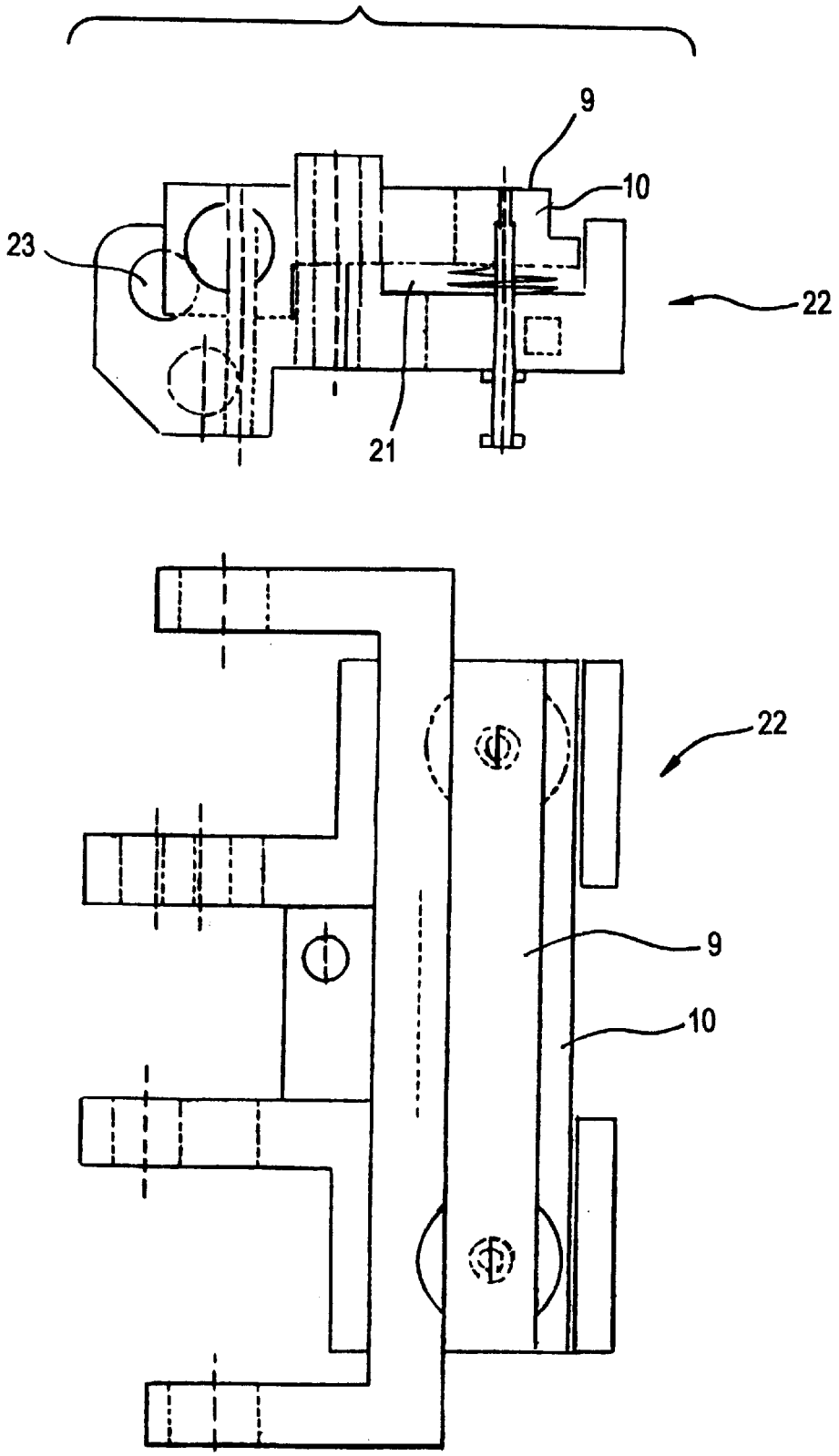
FIG. 4 represents a side elevation and an additional view from above of a second elastic disposition of the table of the sharpening device.

In FIGS. 3 and 4 it is shown in detail how the elastic disposition of the table (10) can be achieved according to two different embodiments.

With the embodiment represented in FIG. 3 the table (10) is provided in a U-shaped horizontal recess (21) of a support (22), while between the bottom of the recess (21) and the table (10) a spring element is provided.

With the embodiment represented in FIG. 4 the table (10) is disposed as in the embodiment from FIG. 3, but the table (10) is furthermore also hingingly connected to a shaft (23) connected to the support (22).

The spring-mounted disposition of the table (10) is important for achieving an optimum sharpening pressure between the cutting knife (12) and the sharpening face of the sharpening belt (4). The sharpening device can also be so made that the spring pressure exerted on the table (10) is adjustable.

The sharpening device according to this invention can also be provided with a detection device for detecting the end or the approaching end of the sharpening belt unwound from a reel (7).

The cutting knife (12) can be maintained razor sharp for a long uninterrupted operation of the weaving machine by placing a sharpening device both above and below the cutting knife (12).

I claim:

1. Sharpening device for the cutting knife (12) of a face-to-face weaving machine, comprising a belt-shaped sharpening means (4) provided with a sharpening face that is so disposable that the cutting knife (12) during movements comes into contact with this sharpening face, and the sharpening means is movable in order to bring various areas of the sharpening face within reach of the cutting knife (12), characterized in that the aforesaid sharpening means (4) is wound up on at least one rotatable reel (3), (7), and that the sharpening device is provided in order to unwind the sharpening means (4) from this reel (7) and wind it up on another reel (3) in order to bring various areas of the sharpening face within reach of the cutting knife (12).

2. Sharpening device for the cutting knife (12) of a face-to-face weaving machine, according to claim 1 characterized in that the sharpening device comprises a curved surface (9), that the sharpening means extends over the curved surface (9) and can be disposed with an area of the sharpening face extending opposite this surface (9) within reach of the cutting knife (12).

3. Sharpening device, according to claim 1 characterized in that the curved surface (9) is part of a spring-mounted part (10) of the device.

4. Sharpening device for the cutting knife (12) of a face-to-face weaving machine, according to claim 1 characterized in that the reels (3), (7) are detachably provided on a respective rotary shaft (2).

5. Sharpening device for the cutting knife (12) of a face-to-face weaving machine, according to claim 1 characterized in that the sharpening means (4) and the reels (3), (7) form a unit which is detachably provided on the device.

6. Sharpening device for the cutting knife (12) of a face-to-face weaving machine, according to claim 1, characterized in that the sharpening means (4) can be driven in a continuous or in an alternative manner.

7. Sharpening device for the cutting knife (12) of a face-to-face weaving machine, according to claim 1 characterized in that it comprises a tensioning device (18) for the sharpening means (4).

8. Sharpening device for the cutting knife (12) of a face-to-face weaving machine, according to claim 1 characterized in that it comprises a cleaning device for the sharpening means (4).

9. Sharpening device for the cutting knife (12) of a face-to-face weaving machine according to claim 1 characterized in that the inclination and the position of the sharpening device are adjustable.

10. A sharpening unit (3, 4, 7) for a sharpening device as specified in claim 1, characterized in that this comprises two rotatable reels (3), (7), that a belt-shaped sharpening means (4) provided with a sharpening face is wound up on at least one reel (3), (7) and runs from one reel to the other, that the sharpening unit is provided on the device in an operating position whereby an area of the sharpening face is within reach of the cutting knife (12), and whereby the sharpening means (4) is unwound from one reel (7) and is wound up on the other reel (3) in order to bring various areas of the sharpening face within reach of the cutting knife (12).

11. A face-to-face weaving machine provided with one or several sharpening devices, each sharpening device comprising a belt-shaped sharpening means (4) provided with a sharpening face that is so disposable that the cutting knife (12) during movements comes into contact with this sharpening face, and the sharpening means is movable in order to bring various areas of the sharpening face within reach of the cutting knife (12), characterized in that the aforesaid sharpening means (4) is wound up on at least one rotatable reel (3), (7), and that the sharpening device is provided in order to unwind the sharpening means (4) from this reel (7) and wind it up on another reel (3) in order to bring various areas of the sharpening face within reach of the cutting knife (12).

* * * * *